US007651301B2

(12) United States Patent
Taniguchi et al.

(10) Patent No.: US 7,651,301 B2
(45) Date of Patent: Jan. 26, 2010

(54) DRILLING HEAD, METHOD OF SOIL IMPROVEMENT WORK AND APPARATUS THEREOF

(75) Inventors: Toshihisa Taniguchi, Ibaraki (JP); Masahiro Nagaishi, Tokyo (JP); Hiroshi Nitao, Kanagawa (JP); Makoto Otsuka, Gifu (JP)

(73) Assignee: Fudo Tetra Corporation, Osaka (JP)

( * ) Notice: Subject to any disclaimer, the term of this patent is extended or adjusted under 35 U.S.C. 154(b) by 375 days.

(21) Appl. No.: 11/614,232

(22) Filed: Dec. 21, 2006

(65) Prior Publication Data

US 2008/0060851 A1 Mar. 13, 2008

(30) Foreign Application Priority Data

Sep. 8, 2006 (JP) ..... 2006-244141
Sep. 8, 2006 (JP) ..... 2006-244145

(51) Int. Cl.
*E02D 3/12* (2006.01)

(52) U.S. Cl. ..... 405/263; 405/266; 405/269; 405/241

(58) Field of Classification Search ..... 405/263, 405/266, 267, 269, 233, 240, 241, 128.75; 175/323
See application file for complete search history.

(56) References Cited

U.S. PATENT DOCUMENTS 3,180,098 A * 4/1965 Spencer ..... 405/263
4,958,962 A * 9/1990 Schellhorn ..... 405/267

FOREIGN PATENT DOCUMENTS

JP 355136326 A * 10/1980
JP 402140321 A * 5/1990
JP 402266017 A * 10/1990
JP 2002-013131 1/2002
JP 2003-074049 3/2003
JP 2005-133367 5/2005
JP 2006-037708 2/2006

OTHER PUBLICATIONS

English Language Abstract of JP 2002-013131.
English Language Abstract of JP 2003-074049.
English Language Abstract of JP 2005-133367.
English Language Abstract of JP 2006-037708.

* cited by examiner

*Primary Examiner*—David J Bagnell
*Assistant Examiner*—Sean D Andrish
(74) *Attorney, Agent, or Firm*—Greenblum & Bernstein, P.L.C.

(57) ABSTRACT

A method of soil improvement work drills the ground with a drilling head arranged at a lower end of a rotary shaft and sends the rotary shaft into the ground. The method mixes pressurized water with compressed air on the ground, to prepare a fluid mixture, feeds the fluid mixture through a feed path arranged along the rotary shaft into an ejector arranged on the drilling head, and ejects the fluid mixture from the ejector toward the ground to drill. An envelope defined by a front end of the drilling head has a conical shape.

5 Claims, 13 Drawing Sheets

DRILLING HEAD, METHOD OF SOIL IMPROVEMENT WORK AND APPARATUS THEREOF

BACKGROUND OF THE INVENTION

1. Field of the Invention

The present invention relates to a drilling head attached to a leading end of a rotary shaft, capable of reducing drilling resistance and easily drilling the ground to put the rotary shaft into the ground. The present invention also relates to a method of and an apparatus for soil improvement work with the use of the drilling head.

2. Description of the Related Art

A method of soil improvement work generally includes feeding a fluid from a fluid source on the ground to a leading end of a rotary shaft to be penetrated into the ground and ejecting the fluid from an ejection mouth toward the ground to be drilled, the ejection mouth being arranged on a mixing blade or a drilling head attached to the leading end of the rotary shaft.

Related arts are disclosed in, for example, Japanese Unexamined Patent Application Publications No. 2002-13131 and No. 2002-74049. According to the related arts, supply sources installed on the ground feed compressed air and a liquid through separate paths formed inside a rotary shaft to a leading end of the rotary shaft and eject the liquid with the compressed air from a mixing ejector arranged on a mixing blade toward drilled soil.

FIG. 1 shows an apparatus for soil improvement work disclosed in the Japanese Unexamined Patent Application Publication No. 2002-13131. In FIG. 1, a rotary shaft 501 is penetrated into the ground. The rotary shaft 501 incorporates an air path 502 for passing compressed air and a liquid path 503 for passing a liquid material. The air path 502 has a top inlet 502*a* that is connected to piping 504*a* extending from an air source 504 for supplying compressed air. The liquid path 503 has a top inlet 503*a* that is connected to piping 505*a* extending from a liquid source 505 for supplying the liquid material.

The air path 502 has a bottom outlet 502*b*, and the liquid path 503 has a bottom outlet 503*b*. The outlets 502*b* and 503*b* are connected to a mixing ejector 507 arranged on a mixing blade 506 attached to a lower end of the rotary shaft 501. The mixing ejector 507 mixes the compressed air supplied through the air path 502 with the liquid material supplied through the liquid path 503 and ejects the mixture.

FIG. 2 shows an example of a drilling head according to a related art used for an apparatus for soil improvement work. This drilling head is disclosed in Japanese Unexamined Patent Application Publication No. 2005-133367. In FIG. 2, the drilling head 520 is attached to a leading end of a rotary shaft 501. The drilling head 520 has a convex shape with a downward apex being on an axis of rotation. Along each ridge slope of the drilling head 520, drill bits 522 are arranged.

FIG. 3 shows another example of a drilling head disclosed in Japanese Unexamined Patent Application Publication No. 2006-37708. In FIG. 3, the drilling head 620 is attached to a leading end of a rotary shaft 501. The drilling head 620 has two spiral blades 621. Bottom edges of the spiral blades 621 are in the same virtual plane and each of the bottom edges is provided with drill bits 622 whose tips are substantially at the same level.

SUMMARY OF THE INVENTION

The related art shown in FIG. 1 supplies compressed air through the air path 502, mixes the compressed air with a liquid material in the mixing ejector 507, and ejects the mixture toward drilled soil. This technique can effectively reduce friction and improve a mixing effect with a small amount of water. Arranging the paths 502 and 503 for different fluids in the rotary shaft 501 and mixing the fluids with each other in the mixing ejector 507 just before ejecting the fluids toward drilled soil need a number of paths (502, 503) to be installed inside the rotary shaft 501, thereby complicating swivel joints and piping inside the rotary shaft 501 and increasing facility cost.

Existing apparatuses for improving the ground usually have only one or two fluid paths inside a rotary shaft, and therefore, the existing apparatuses are unable to adopt the techniques disclosed in the Japanese Unexamined Patent Application Publications No. 2002-13131 and No. 2002-74049 because the disclosed techniques compel the existing apparatuses to achieve large design changes and bear high cost.

In consideration of the problems of the related arts, the present invention provides a method of and an apparatus for soil improvement work, capable of suppressing a cost increase, reducing a drilling resistance when driving a rotary shaft into the ground, and improving a construction efficiency.

According to the related art shown in FIG. 2, the drilling head 520 has a convex sectional shape with a downward protruding center. This shape may provide a good cutting performance but it easily causes an axial displacement when it hits a local hard obstacle. In addition, thrust acting on the drilling head 520 pushes soil under the drilling head 520 sideward, and therefore, the drilling head 520 hardly bites the ground.

According to the related art shown in FIG. 3, the drilling head 620 has the drill bits 622 that are horizontally arranged to bore the ground. This arrangement may be resistive to an axial displacement when it hits a local hard obstacle. The arrangement, however, involves a large drilling resistance because the center and periphery of the drilling head 620 simultaneously cut the ground, thereby deteriorating a drilling efficiency.

In consideration of these problems, the present invention provides a drilling head capable of preventing an axial displacement and efficiently drilling the ground. The present invention also provides an apparatus for soil improvement work employing such a drilling head.

A first aspect of the present invention provides a drilling head attached to a lower end of a rotary shaft to be penetrated into the ground. The drilling head includes a plurality of spiral blades arranged at regular intervals around an axis of rotation of the rotary shaft and drill bits attached to a lower edge of each of the spiral blades. When the rotary shaft is rotated, the lower edges of the spiral blades define an envelope with a central part of the envelope rising in an upward direction from an outer circumferential part of the envelope.

A second aspect of the present invention provides a method of soil improvement work. The method includes drilling the ground with a drilling head arranged at a lower end of a rotary shaft, to sink the rotary shaft into the ground and mixing one of pressurized water and a stabilizer with compressed air on the ground, to prepare a fluid mixture. When driving the rotary shaft into the ground, the method feeds the fluid mixture through a first feed line arranged along the rotary shaft into the drilling head, ejects the fluid mixture from the drilling head toward drilled soil, and sends the rotary shaft up to a predetermined depth.

A third aspect of the present invention provides an apparatus for soil improvement work. The apparatus includes a rotary shaft vertically supported and to be penetrated into the ground, a drilling head arranged at a leading end of the rotary shaft, a lifting driver configured to rotate and move up/down the rotary shaft, a first conduit arranged along the rotary shaft, an ejector arranged on the drilling head and connected to a first end of the first conduit, a water feeder and an air feeder arranged on the ground, water piping configured to feed pressurized water from the water feeder into a second end of the first conduit, a joint arranged at a location that is upstream from and in the vicinity of a connection between the water piping and the first conduit, air piping configured to feed compressed air from the air feeder into the joint, a check valve arranged in the air piping, to prevent the fluid from reversely flowing from the joint, and a safety valve arranged in the air piping and upstream from the check valve, to release pressure if the pressure exceeds a predetermined level.

DESCRIPTION OF THE PREFERRED EMBODIMENTS

Embodiments of the present invention will be explained with reference to the accompanying drawings.

Figure 1:
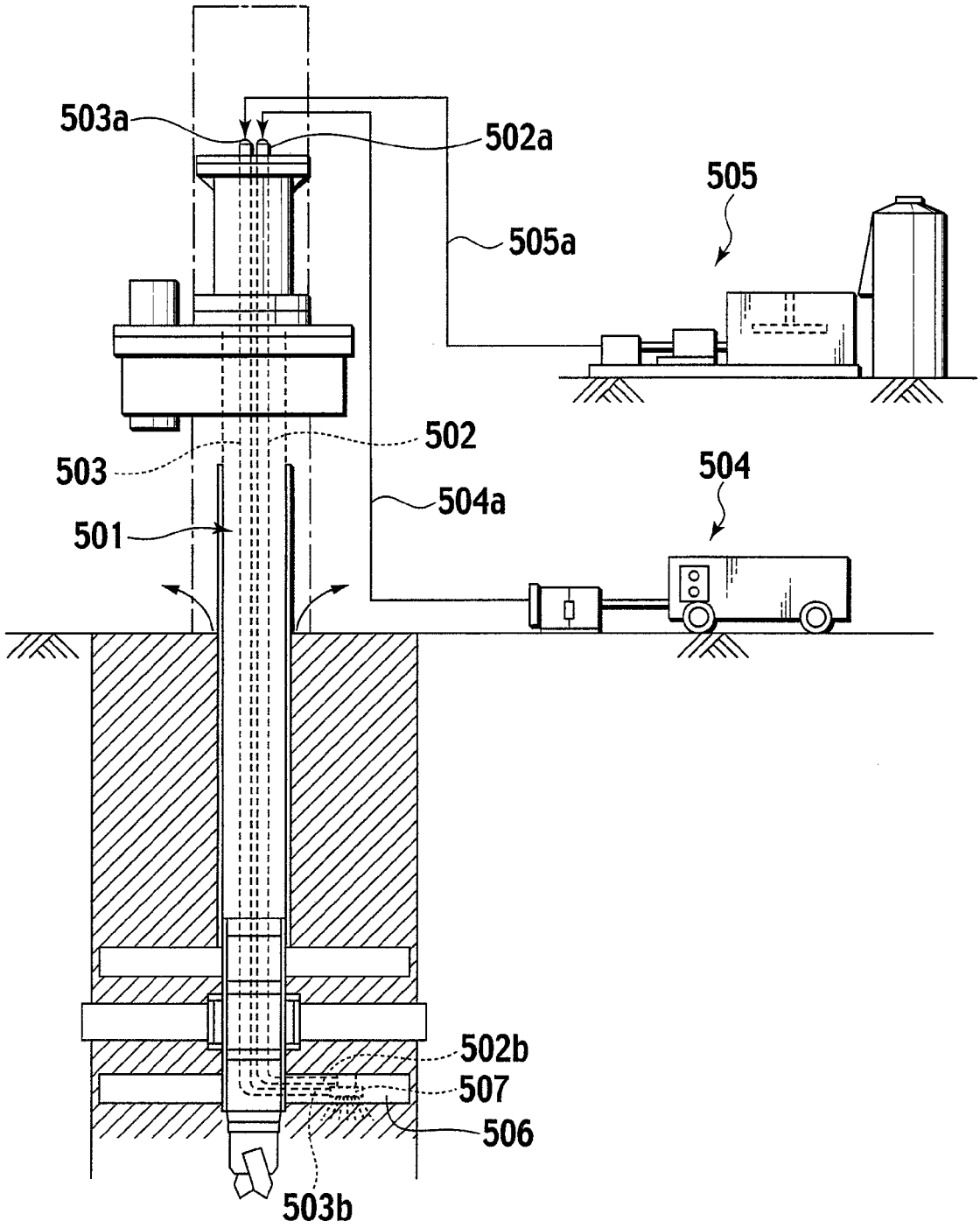
FIG. 1 PRIOR ART
FIG. 1 is a side view showing an apparatus for soil improvement work according to a related art.
Figure 2:
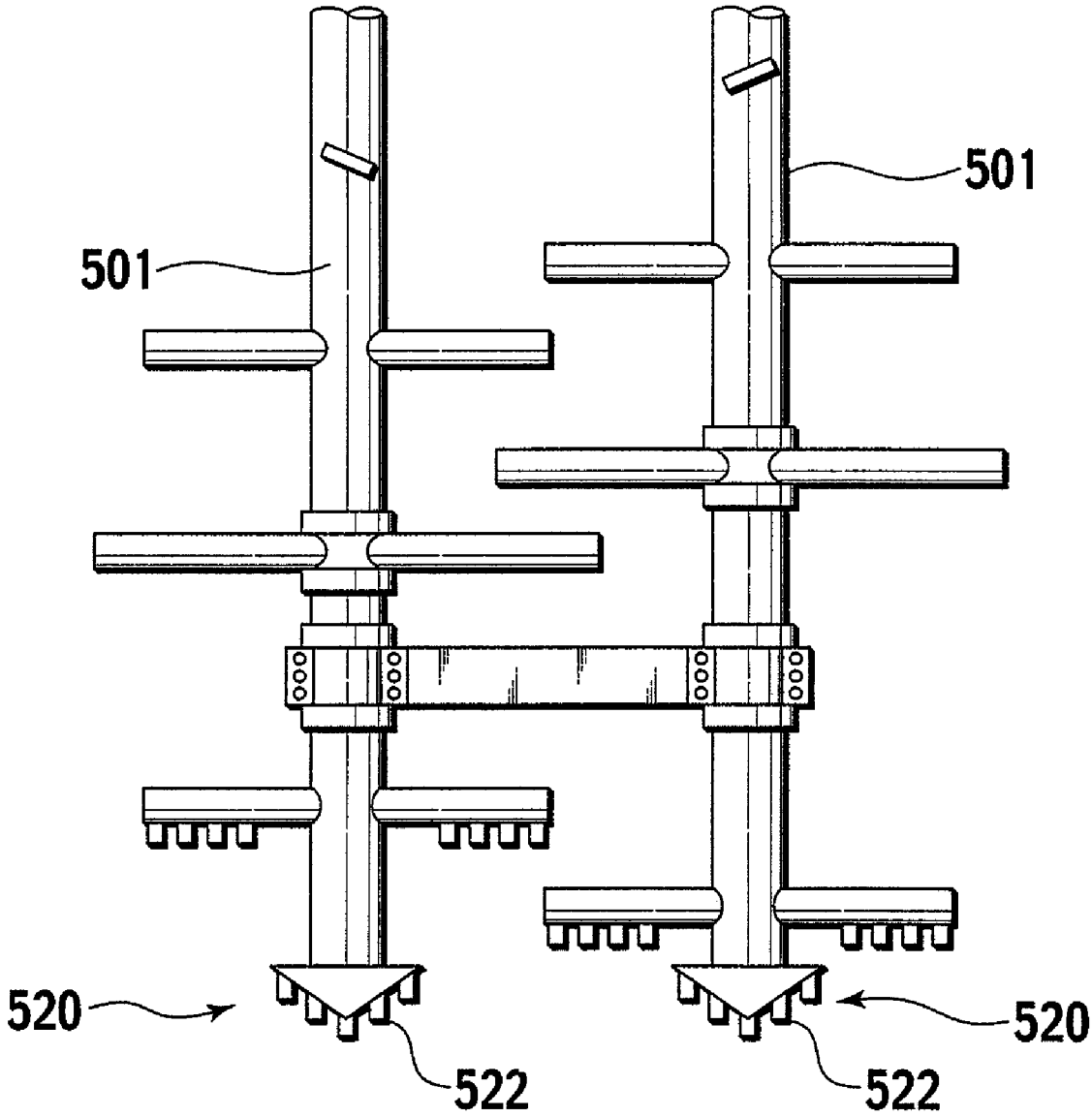
FIG. 2 PRIOR ART
FIG. 2 is a side view showing an example of a drilling head according to another related art.
Figure 3:
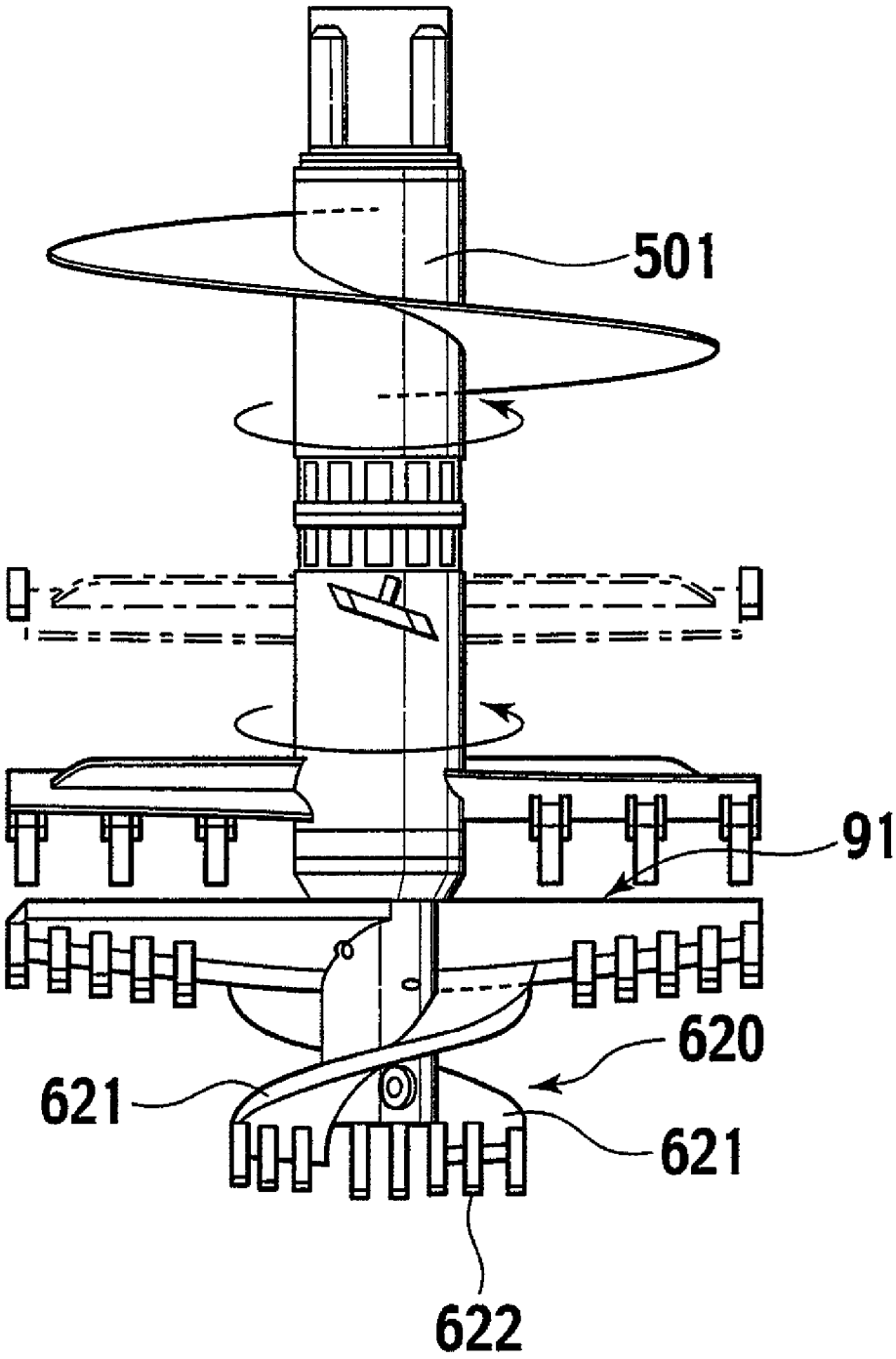
FIG. 3 PRIOR ART
FIG. 3 is a side view showing another example of a drilling head according to still another related art.
Figure 4:
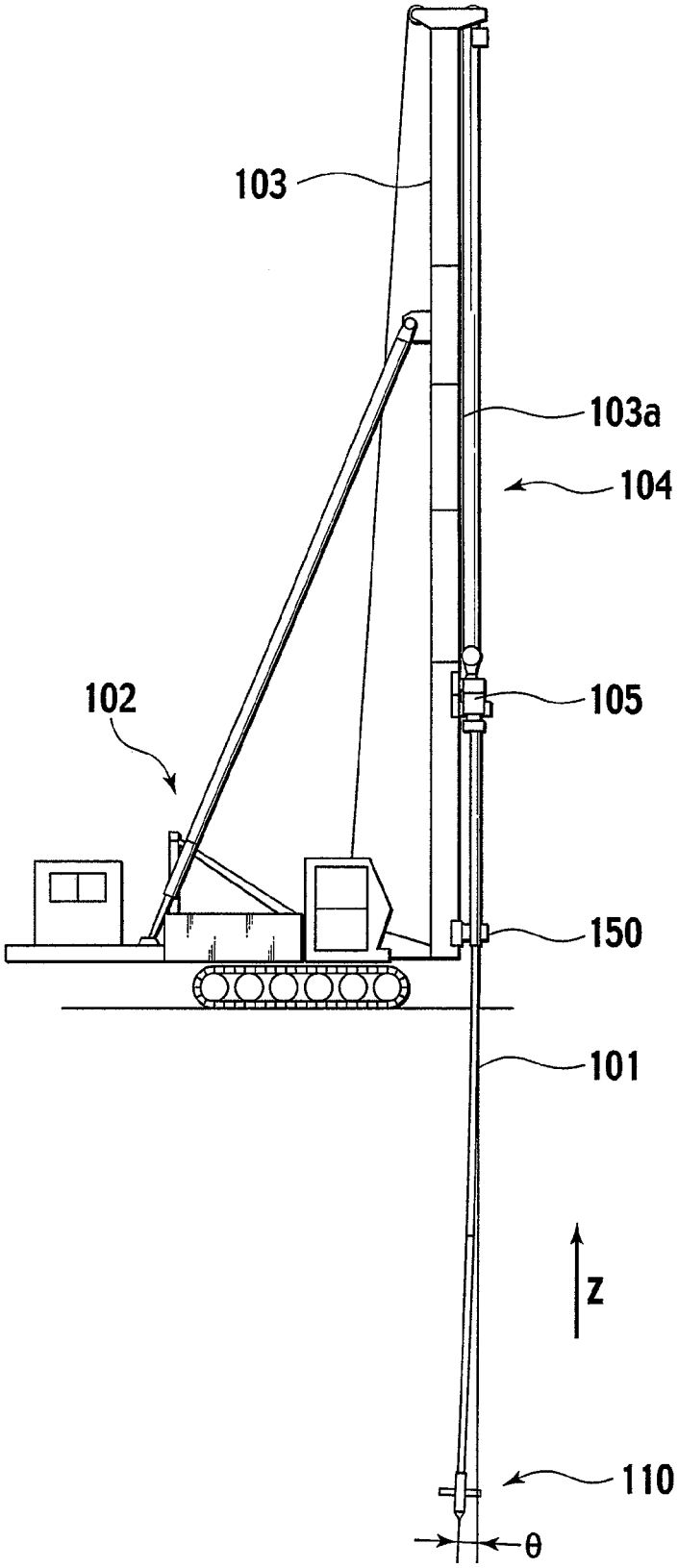
FIG. 4 is a side view generally showing an apparatus for soil improvement work according to an embodiment of the present invention.

FIG. 4 is a side view generally showing an apparatus for soil improvement work according to an embodiment of the present invention. The apparatus includes a rotary shaft 101. The rotary shaft 101 is movable up and down and is supported substantially plumb with a guide 103*a* of a leader 103 installed on a base machine 102. The rotary shaft 101 is moved up and down by a lifting driver 104 that is suspended with wires. The lifting driver 104 includes a motor 105 as a rotational driver. In the apparatus for soil improvement work, the lifting driver 104 moves the rotary shaft 101 up and down and the motor 105 turns the rotary shaft 101, so that a drilling-mixing unit 110 attached to the rotary shaft 101 may drill the ground. After drilling the ground, the apparatus ejects a stabilizer into drilled soil and mixes the stabilizer with the soil, thereby improving the soil. The leader 103 has a steady mechanism 150 arranged at a lower part of the leader 103, to guide the rotary shaft 101 when the rotary shaft 101 is driven going into the ground.

Figure 5:
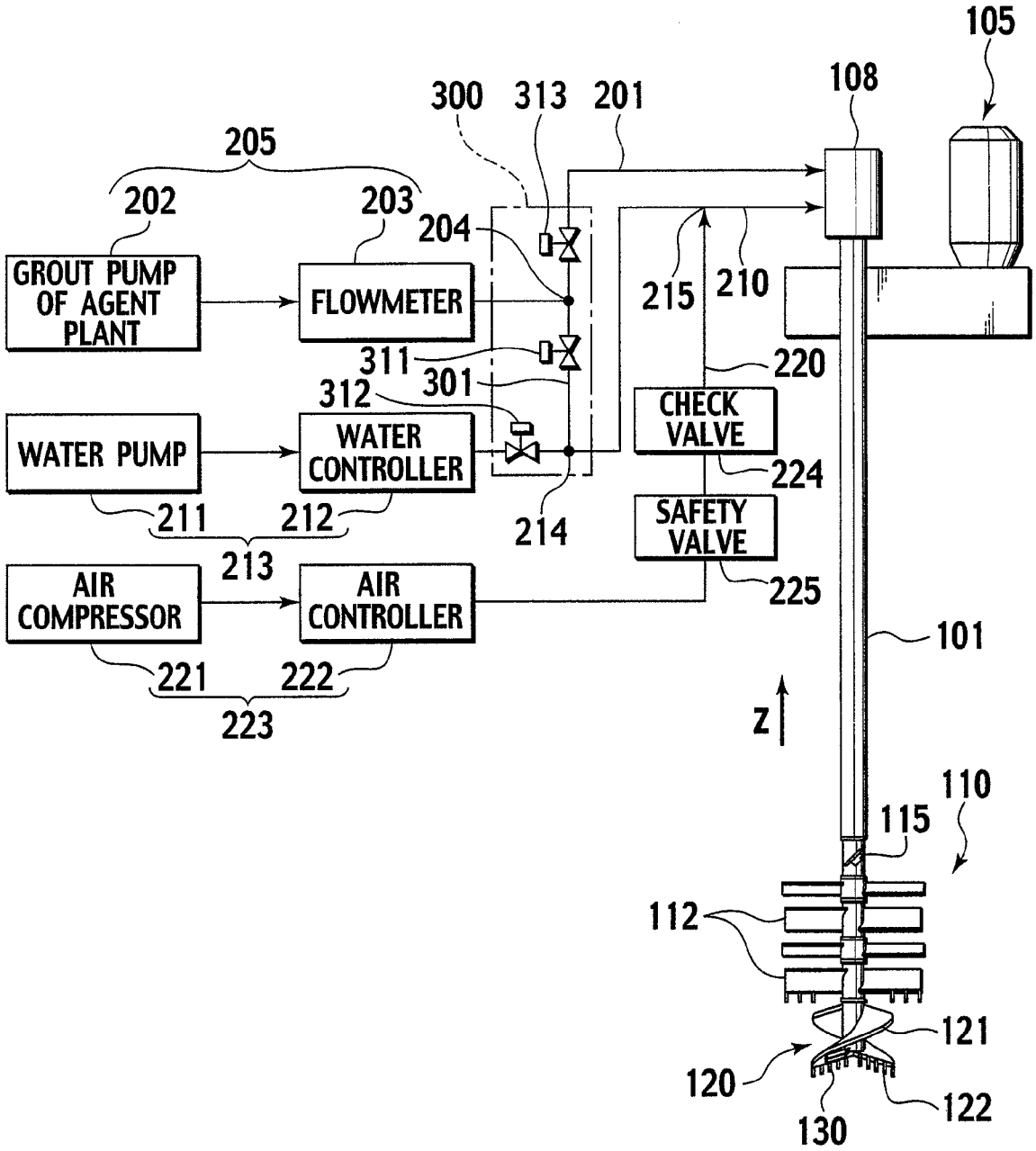
FIG. 5 is a view partly showing the apparatus of FIG. 4.

FIG. 5 is a view partly showing the apparatus of FIG. 4. The rotary shaft 101 incorporates a first conduit (not shown) that defines a first feed line for passing a friction reducing fluid that is a mixture of pressurized water and compressed air. The rotary shaft 101 also incorporates a second conduit (not shown) that defines a second feed line for passing a stabilizer. The first and second feed lines are different from each other.

The stabilizer is, for example, cement slurry that is supplied from a stabilizer feeder 205 installed on the ground. The stabilizer feeder 205 includes an agent plant grout pump 202 and a flowmeter 203. The grout pump 202 sends a suspension of stabilizer, which is passed through the flowmeter 203, stabilizer piping 201, and a swivel joint 108 into a top inlet of the second conduit arranged inside the rotary shaft 101. The stabilizer piping 201 also defines the second feed line.

On the ground, a water feeder 213 and an air feeder 223 are arranged. The water feeder 213 includes a water pump 211 for pressurizing water and a water controller 212 for controlling the pressure and flow rate of pressurized water. The pressurized water is passed through water piping 210 and the swivel joint 108 into a top inlet of the first conduit arranged inside the rotary shaft 101. The water piping 210 also defines the first feed line for passing a friction reducing fluid.

Just before a connection between the water piping 210 and the swivel joint 108, there is a joint 215 to which a front end of air piping 220 is connected. The air piping 220 extends from the air feeder 223.

The air feeder 223 includes an air compressor 221 and an air controller 222 for controlling the pressure and flow rate of compressed air. The compressed air is passed through the air piping 220 into the joint 215 where the compressed air is mixed with the pressurized water supplied through the water piping 210 of the first feed line. Generally, a pressure of the pressurized water is higher than a pressure of the compressed air, and therefore, air bubbles are mixed and compressed into fine air bubbles when the compressed air is mixed with the pressurized water. The fine air bubbles are dispersed through the pressurized water, and the mixture passes the first feed line up to an ejector 130 attached to the drilling-mixing unit 110.

There is a possibility that the pressure of the water piping 210 greatly differs from the pressure of the air piping 220. To cope with such a situation, a check valve 224 is arranged in the air piping 220, to prevent a fluid from reversely flowing from the joint 215 into the air piping 220. In addition, a safety valve 225 is arranged also in the air piping 220 upstream from the check valve 224, to release pressure if the pressure exceeds a set level.

Between the stabilizer piping 201 and the water piping 210, a selector 300 is arranged to guide, if required, the stabilizer from the stabilizer feeder 205 to the first conduit that is usually used to pass pressurized water. In the selector 300, connection piping 301 connects a branch point 204 of the stabilizer piping 201 to a branch point 214 of the water piping 210. Passage of the connection piping 301 is controllable by opening and closing a first valve 311. When the first valve 311 is opened, a second valve 312 is closed to prevent a fluid from reversely flowing from the branch point 214 of the connection piping 301 toward the upstream side of the water piping 210. A third valve 313 is arranged in the stabilizer piping 201 downstream from the branch point 204 of the connection piping 301. The third valve 313 is interlocked with the first valve 311 and is oppositely opened/closed from the first valve 311. The first to third valves 311 to 313 are solenoid valves that are controlled by a controller (not shown) in an interlocked manner.

Drilling-Mixing Unit

Figure 6:
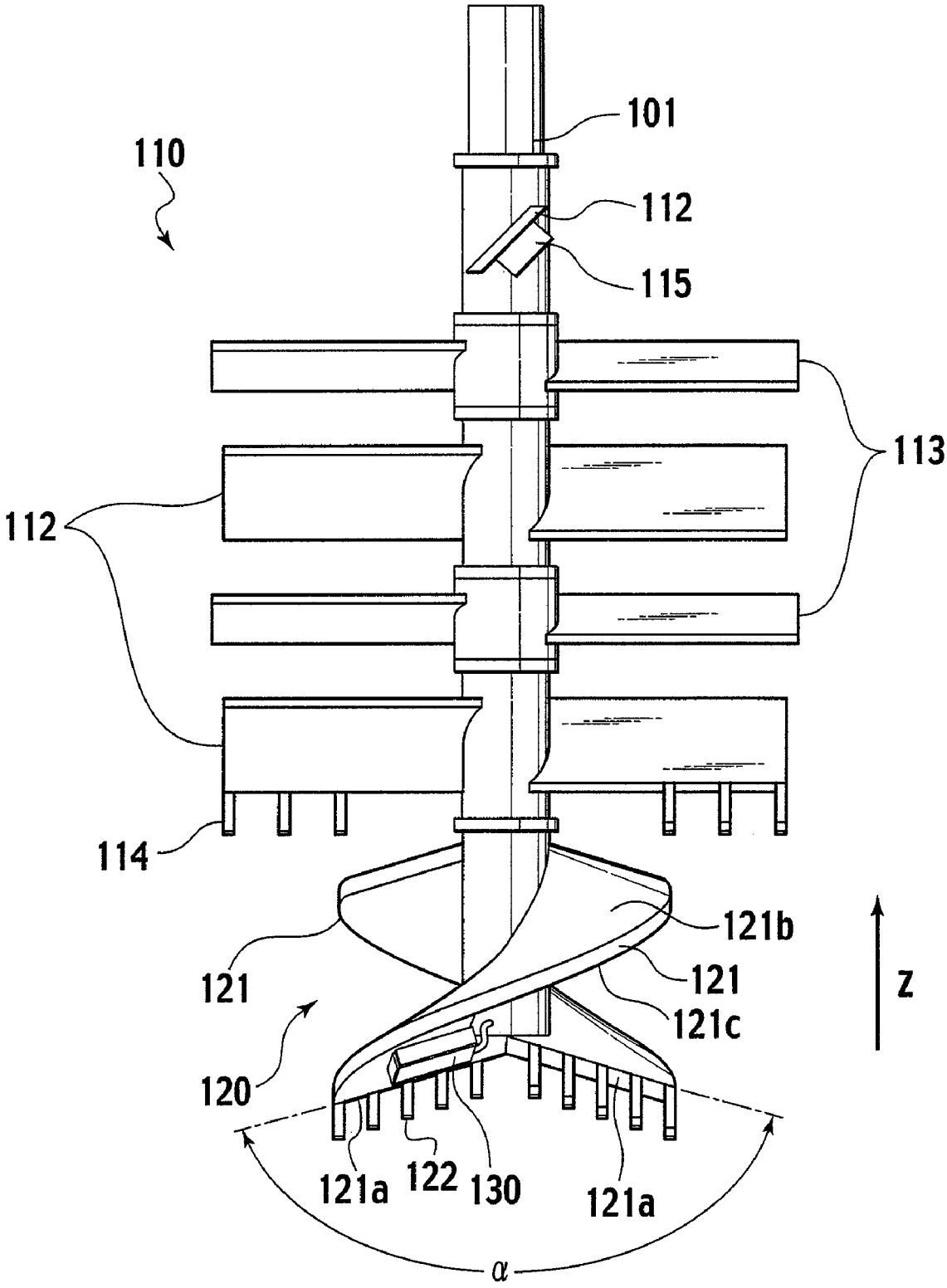
FIG. 6 is a side view showing a drilling-mixing unit arranged at a leading end of a rotary shaft of the apparatus of FIG. 4.

FIG. 6 is a side view showing the drilling-mixing unit 110 arranged at a leading end of the rotary shaft 101 of the apparatus of FIG. 4. In FIG. 6, the drilling-mixing unit 110 includes a drilling head 120 attached to a leading end of the rotary shaft 101. Above the drilling head 120, mixing blades 112 and corotational plates 113 are alternately arranged in plural stages in a vertical direction. According to the embodiment of FIG. 6, the rotational radius of the drilling head 120 is smaller than that of the mixing blades 112.

Each mixing blade 112 has a bar shape that linearly extends from the rotary shaft 101 in a radial direction and inclines relative to the axis of the rotary shaft 101. The lowermost mixing blades 112 have drill bits 114 along lower edges thereof, to realize a drilling function in addition to the mixing function. A back face of the uppermost mixing blade 112 is provided with a discharger 115 to discharge the stabilizer fed through the second conduit arranged inside the rotary shaft 101. The discharging of stabilizer from the discharger 115 is mainly carried out when the rotary shaft 101 is lifted from a hole drilled in the ground by the rotary shaft 101.

The drilling head 120 includes two spiral blades 121 each having a bottom edge 121a provided with drill bits 122. The spiral blades 121 are 180° -symmetrical with respect to the rotary shaft 101. Each spiral blade 121 is twisted within an angular range of 180° , i.e., each spiral blade 121 extends for a half pitch.

The bottom edges of the spiral blades 121 define an envelope, which is preferably a cone with its center being higher in a z-direction than its periphery. In FIG. 6, the bottom edge 121*a* of each spiral blade 121 forms a linear slope that rises from a peripheral end thereof toward an inner end thereof. When the drilling head 120 is turned, the lower edges 121*a* of the two spiral blades 121 form a conical envelope with its center upwardly protruding and its periphery being lower than the center. The bottom edge 121*a* of the spiral blade 121 has a vertical face that extends substantially in the z-direction. To the vertical face, the drill bits 122 are attached. An angle $\alpha$ formed between the two bottom edges 121*a* is set to be in the range of 45° to 180°.

When the drilling head 120 is turned and thrust, the drilling head 120 bites into the ground and upwardly pushes soil toward the rotary shaft 101, to stabilize the center of rotation and efficiently discharge the soil in an upward direction.

Figure 7:
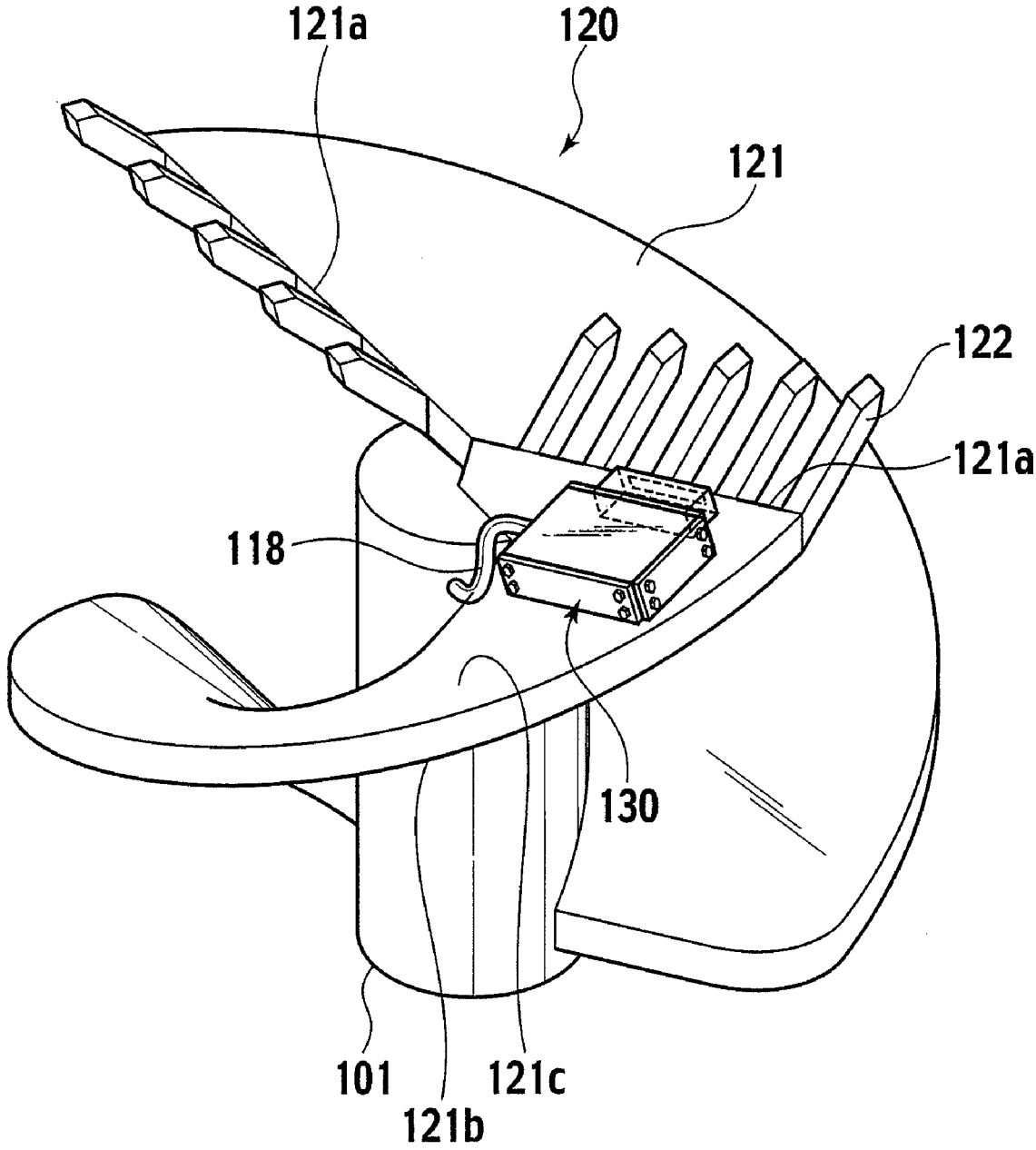
FIG. 7 is an upside-down perspective view showing a drilling head of the drilling-mixing unit of FIG. 6.
Figure 8A:
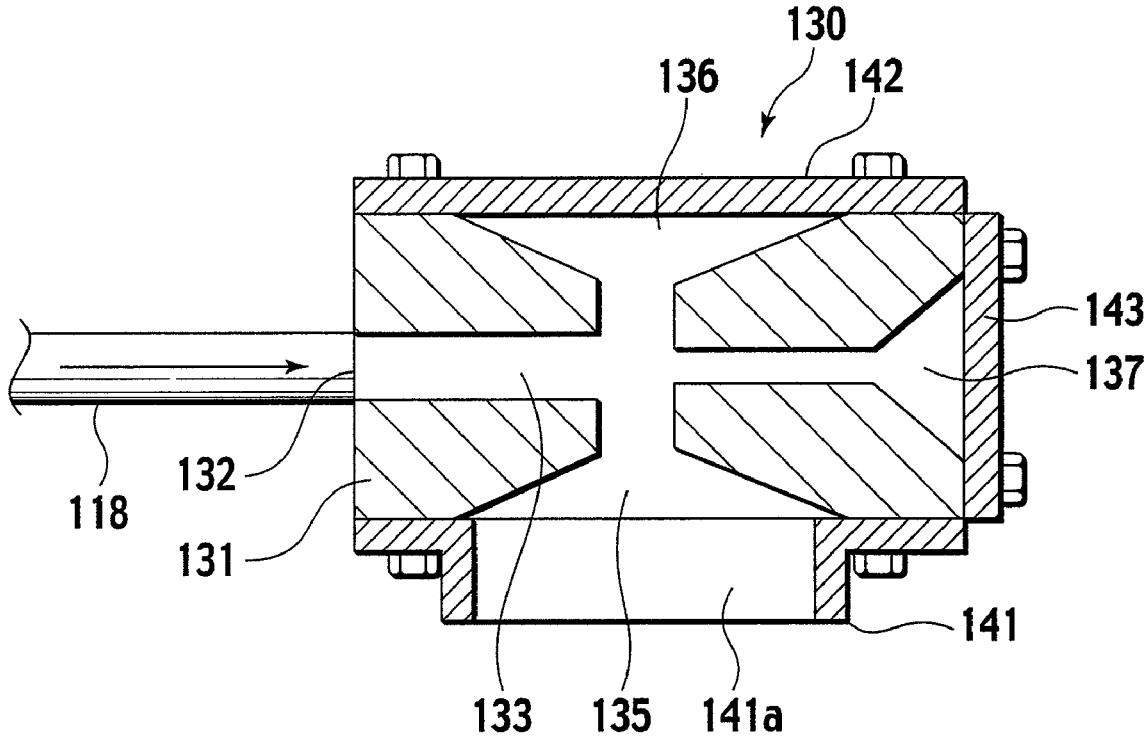
FIG. 8A is a sectional view showing an ejector arranged on a back face of a spiral blade of the drilling head of FIG. 7.
Figure 8B:
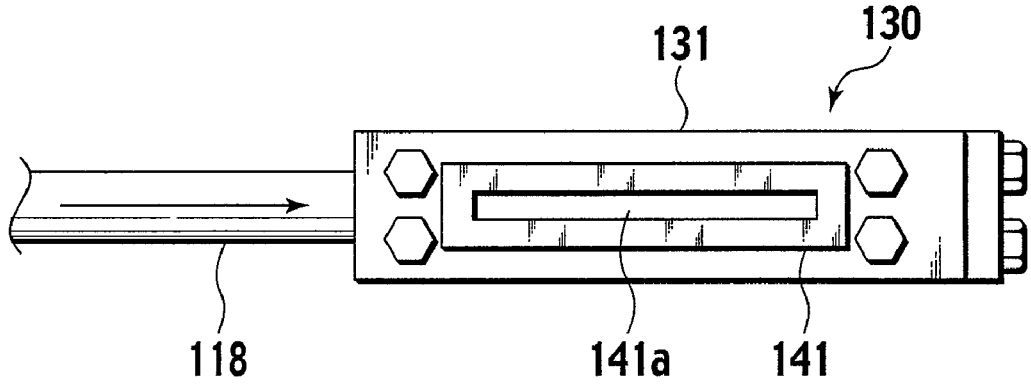
FIG. 8B is a side view showing the ejector of FIG. 8A.

FIG. 7 shows the ejector 130 attached to a back face 121*c* (opposite to a front face 121*b* for upwardly scooping soil) of one of the spiral blades 121. The ejector 130 is used to eject a friction reducing fluid. FIGS. 8A and 8B show the details of the ejector 130. In FIGS. 8A and 8B, the ejector 130 includes a body 131 that is a rectangular block and covers 141, 142, and 143 fixed to the body 131 with bolts.

The body 131 has an inlet 132 on an end face thereof, to receive a friction reducing fluid. The inlet 132 is connected to a branch pass 133 communicating with ejection mouths 135, 136, and 137 that are open to the remaining end faces of the body 131, respectively. When the ejector 130 is attached to the back face 121*c* of the spiral blade 121, the ejection mouth 135 faces a rotational direction of the spiral blades 121, the ejection mouth 136 faces opposite to the rotational direction of the spiral glace 121, and the ejection mouth 137 faces an outward radial direction of the spiral blade 121. The inlet 132 of the body 131 is connected to a pipe 118 at a front end of the first conduit arranged inside the rotary shaft 101.

The ejection mouths 135, 136, and 137 have removable covers 141, 142, and 143, respectively. Among the covers, only the cover 141 is provided with an opening 141*a* to open the ejection mouth 135 toward the outside. The other covers 142 and 143 close the ejection mouths 136 and 137, respectively. When the open cover 141 is attached, the corresponding ejection mouth 135 is opened. When the closed covers 142 and 143 are attached, the corresponding ejection mouths 136 and 137 are closed. Accordingly, by replacing the covers 141 to 143 with one another, any one of the ejection mouths 135, 136, and 137 can selectively be opened.

Method of Soil Improvement Work

A method of soil improvement work according to an embodiment of the present invention using the above-mentioned apparatus for soil improvement work and drilling head will be explained.

1. The lifting driver 104 and motor 105 are driven to turn the rotary shaft 101 and descend the drilling head 120 toward the ground. The drilling head 120 at the leading end of the rotary shaft 101 drills the ground to send the rotary shaft 101 into the ground.

2. During the drilling operation, the water feeder 213 feeds pressurized water and the air feeder 223 feeds compressed air. The pressurized water and compressed air are mixed with each other at the joint 215, to form a fluid mixture with air bubbles dispersed through the pressurized water.

3. The fluid mixture serving as a friction reducing fluid is passed through the first feed line including the swivel joint 108 and the first conduit in the rotary shaft 101 up to the drilling head 120.

4. The fluid mixture fed to the drilling head 120 is ejected from one of the ejection mouths 135, 136, and 137 of the ejector 130 toward drilled soil. In the example of FIG. 8A, the ejection mouth 135 is open, and therefore, the fluid mixture is ejected through the cover 141 and opening 141*a* of the ejection mouth 135 in a forward direction of a rotational direction of the spiral blades 121.

5. When the rotary shaft 101 reaches a predetermined depth, the grout pump 202 is driven to feed a stabilizer. The stabilizer is passed through the stabilizer piping 201 and second conduit in the rotary shaft 101 and is discharged from the discharger 115 attached to the mixing blade 112. At the same time, the rotary shaft 101 is lifted up so that the stabilizer is mixed with site soil to form an improved pillar or pile.

These steps carried out with the apparatus for soil improvement work can efficiently improve soil at the site.

Drilling Resistance of Drilling Head

Jetting a mixture of pressurized water and compressed air from one of the ejection mouths 135 to 137 attached to the drilling head 120 toward drilled soil efficiently reduces friction or resistance between the drilling head 120 and the soil and improves a drilling efficiency. This results in minimizing an axial displacement $\theta$ of the rotary shaft 101 shown in FIG. 4 due to uneven drilling resistance.

The bottom edges 121*a* of the spiral blades 121 of the drilling head 120 define a conical envelope having an upwardly protruding central part and a lower circumferential part. As a result, the lower circumference of the envelope first bites the ground. Even if the ground locally contains hard obstacles, the drill bits 122 on the peripheral side of the bottom edges 121*a* of the spiral blades 121 first drill the ground, so that the rotary shaft 101 may be stable irrespective of the obstacles.

The apparatus according to the embodiment, therefore, can minimize an axial displacement θ of the rotary shaft 101 due to irregular drilling resistance and correctly perform drilling. The recessed central part and protruding peripheral part of the drilling head 120 cause a drilling strength difference between the center and the periphery of the drilling head 120. As a result, strong peripheral drilling force pushes soil toward the center of the drilling head 120, to improve a drilling efficiency and prevent an axial deviation. The two spiral blades 121 can efficiently convey the soil. The apparatus of the embodiment needs a small thrusting force to produce a sufficient drilling force to drill the ground.

Mixing Compressed Air with Pressurized Water

Pressurized water from the water feeder 213 and compressed air from the air feeder 223 are mixed with each other into a fluid mixture containing dispersed very small air bubbles. The fluid mixture is passed through the first conduit in the rotary shaft 101 up to the drilling head 120. This configuration minimizes the number of conduits installed in the rotary shaft 101, thereby saving cost.

Only by forming the joint 215 in the water piping 210 and connecting the air piping 220 to the joint 215, compressed air can be dispersed into pressurized water to form a fluid mixture. With this simple structure, the fluid mixture can be introduced into a single conduit arranged inside the rotary shaft 101.

The check vale 224 and safety valve 225 are arranged in the air piping 220 before the joint 215. Even if the pressure of the water piping 210 suddenly increases, the check valve 224 can surely prevent pressurized water from reversely flowing toward the air feeder 223. Even if the pressure of the air piping 220 suddenly increases, the safety valve 225 can prevent the pressure from exceeding a predetermined level. This configuration secures the safety of the air feeder 223.

Ejecting Fluid Mixture from Ejector

The back face of the spiral blade 121 of the drilling head 120 is provided with the ejector 130, which is provided with the ejection mouths 135 to 137 to determine a fluid ejection direction. This configuration enables a mixture of pressurized water and compressed air to be ejected in a required direction. The mixture of water and air is prepared before it enters the ejector 130. Namely, the ejector 130 is not required to mix water and air with each other. Accordingly, the ejector 130 having the ejection mouths 135 to 137 can freely be laid out with the ejection mouths 135 to 137 being oriented in proper directions.

Among the ejection mouths 135 to 137, one is opened and the remaining ones are closed. The opened one is provided with an open cover, and the closed ones are provided with closed covers, so that a fluid mixture is ejected in a direction selected from a forward direction of a rotational direction of the spiral blades 121, a direction opposite to the forward direction, and an outward radial direction of the rotational direction of the spiral blades 121.

When drilling the ground mainly made of low viscosity material such as sand, a mixture of pressurized water and compressed air is ejected in a forward direction of a rotational direction of the spiral blades 121, to reduce drilling resistance in front of the spiral blades 121. If the ground to drill has a large viscosity, the water-air mixture is ejected in a direction opposite to the forward direction, to reduce resistance against sediments moving along the back faces of the spiral blades 121, thereby reducing drilling resistance. When drilling the ground for making a joint pile, the water-air mixture is ejected in an outward radial direction of the spiral blades 121, to reduce rotational resistance along the peripheries of the spiral blades 121.

Modifications

Figure 9:
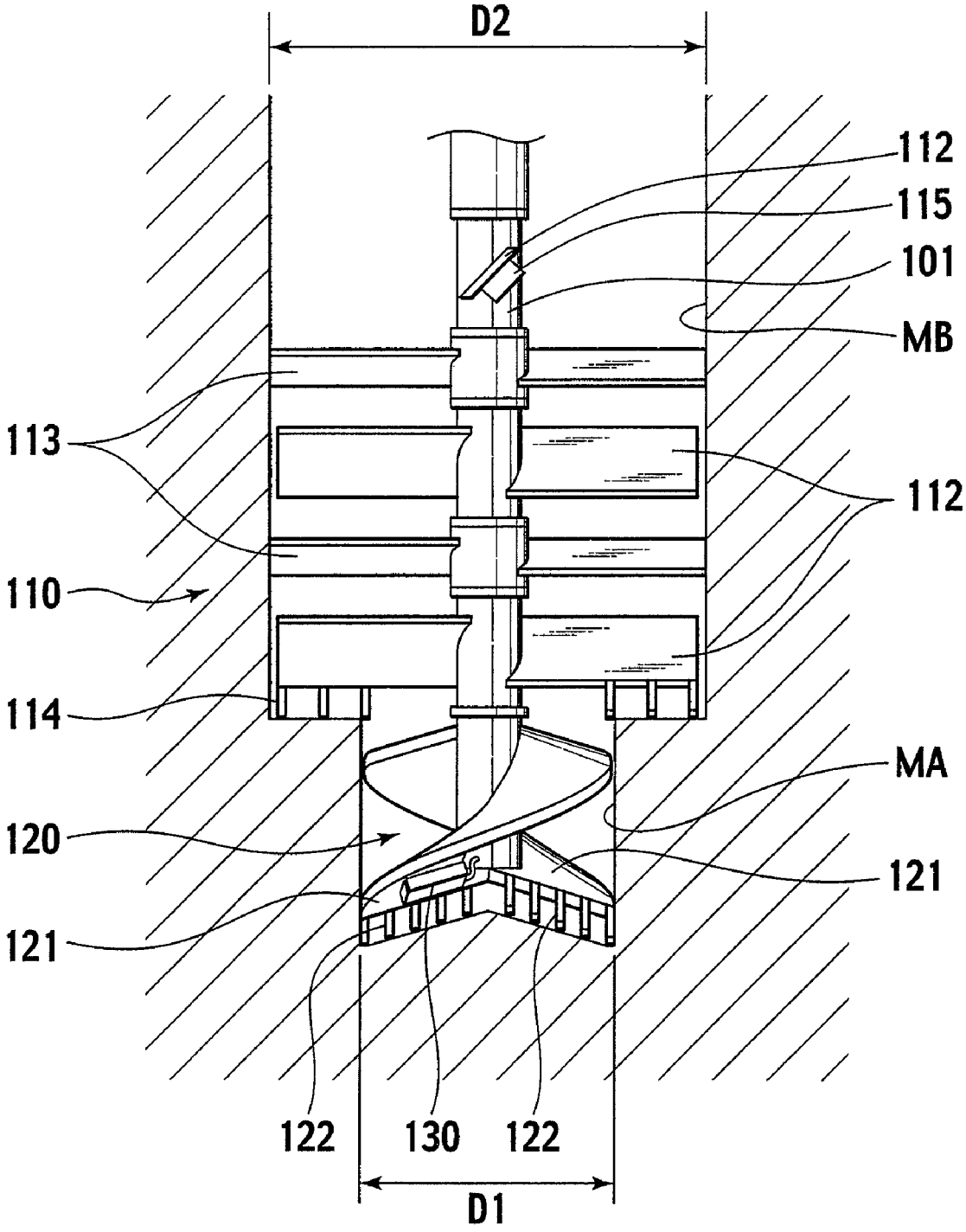
FIG. 9 is a sectional view showing the ground drilled with the drilling-mixing unit of FIG. 6.
Figure 10:
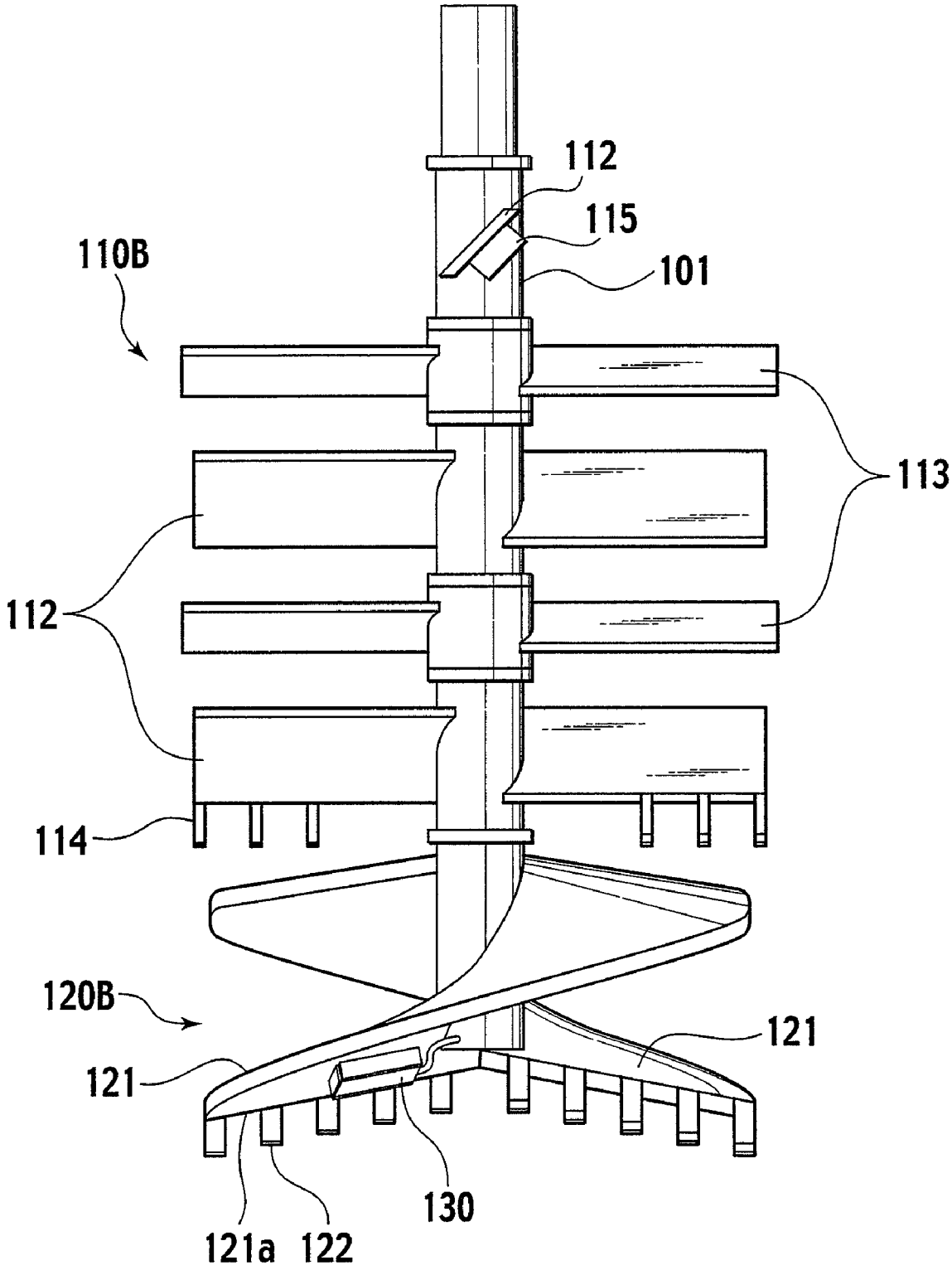
FIG. 10 is a side view partly showing a drilling-mixing unit of an apparatus for soil improvement work according to another embodiment of the present invention.
Figure 11:
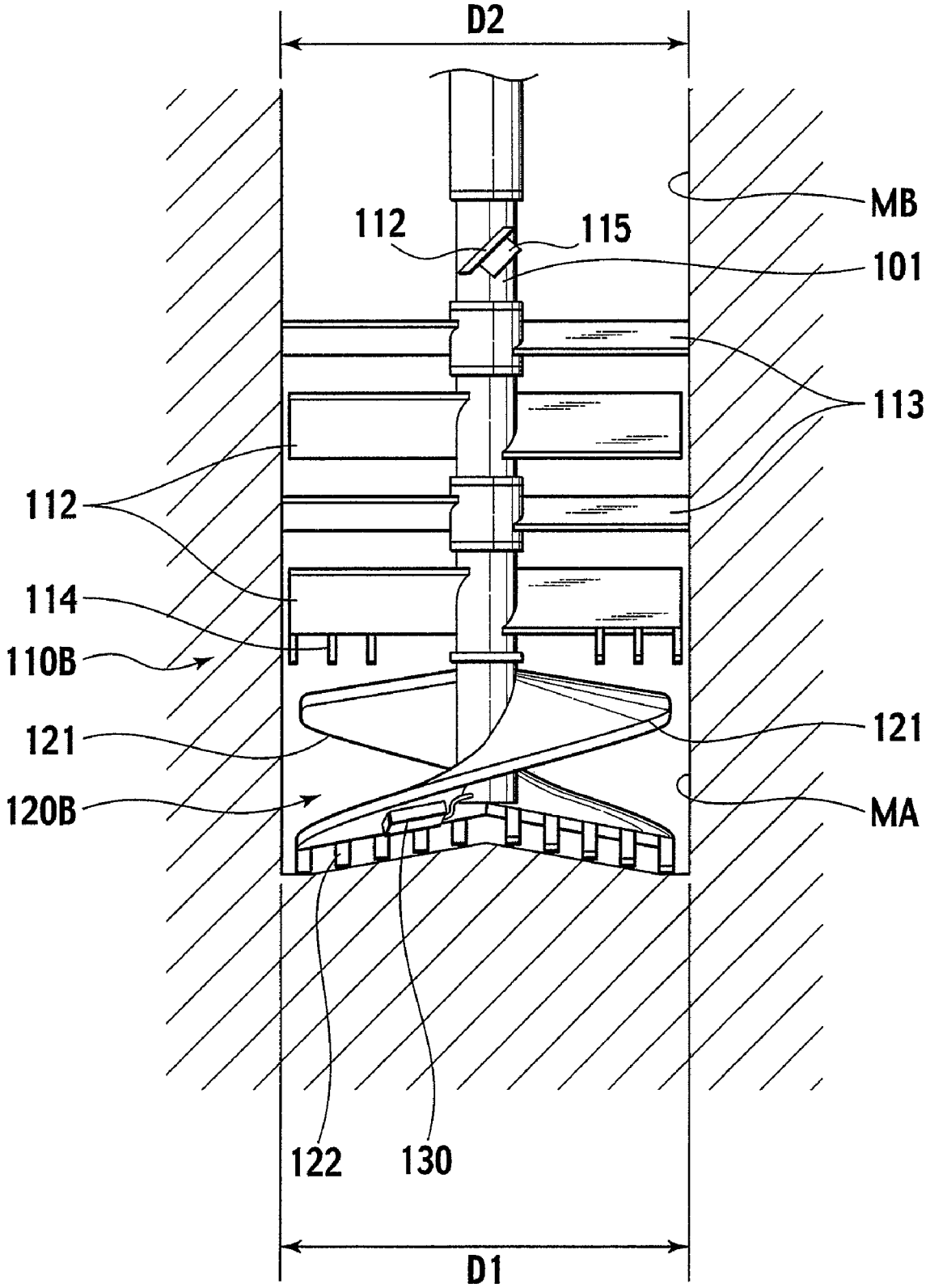
FIG. 11 is a sectional view showing the ground drilled with the apparatus of FIG. 10.

FIG. 9 shows that a radius of rotation of the drilling head 120 is smaller than that of the mixing blade 112. As a result, the diameter D1 of a bottom MA of a drilled hole is smaller than the diameter D2 of an improved body (pile) forming hole MB. Accordingly, a portion corresponding to the height of the drilling head 120 will be out of specification for a required pile having a predetermined diameter and a predetermined depth (height). To form the required pile, a hole to be dug for the pile must be deeper by the height of the drilling head 120 than the required height of the pile. FIGS. 10 and 11 show a drilling-mixing unit 110B according to a modification of the present invention. A radius of rotation of a drilling head 120B of the unit 110B is substantially equal to that of a mixing blade 112. As a result, the diameter D1 of a bottom MA of a drilled hole is substantially equal to the diameter D2 of an improved body (pile) forming hole MB. In this case, the drilled hole will entirely have an effective diameter for the pile to be formed.

As explained above, the discharger 115 is arranged on the uppermost mixing blade 112, to discharge a stabilizer to be mixed with drilled soil at the site. In addition to this, the selector 300 is arranged so that the stabilizer may be passed through the water piping 210 and the first conduit arranged inside the rotary shaft 101 to the ejector 130, which ejects the stabilizer. This configuration can supply the stabilizer into site soil at the level of the drilling head 120.

The stabilizer may be discharged from both the ejector 130 on the drilling head 120 and the discharger 115 on the mixing blade 112 at an optional ratio that may freely be changed in the range of 10:0 to 0:10. To achieve this, the second valve 312 is closed and the first and third valves 311 and 313 are opened at a proper opening ratio. A portion of the stabilizer is passed through the stabilizer piping 201 and second conduit to the discharger 115 on the mixing blade 112, and the remaining portion of the stabilizer is passed through the water piping 210 and first conduit to the ejector 130 on the drilling head 120. Thereafter, the stabilizer is discharged from both the discharger 115 and ejector 130 into drilled soil.

If the ground to drill is soft, the rotary shaft 101 is penetrated into the ground by switching the supply of water and the supply of a stabilizer from one to another, so that the ejector 130 on the drilling head 120 may alternately eject pressurized water and the stabilizer therefrom. This technique can mix the stabilizer with drilled soil while the rotary shaft 101 is being submerged into the ground.

If the ground to drill is hard, the rotary shaft 101 is penetrated into the ground with the ejector 130 on the drilling head 120 ejecting pressurized water therefrom. After the rotary shaft 101 is put into a predetermined depth, the rotary shaft 101 is lifted up with the discharger 115 on the mixing blade 112 discharging a stabilizer and also the ejector 130 on the drilling head 120 ejecting the stabilizer, so that the stabilizer is mixed with site soil.

The selector 300 is easily realizable by providing the stabilizer piping 201 and water piping 210 with the connection piping 301 and three valves 311 to 313.

First Modification

Figure 12:
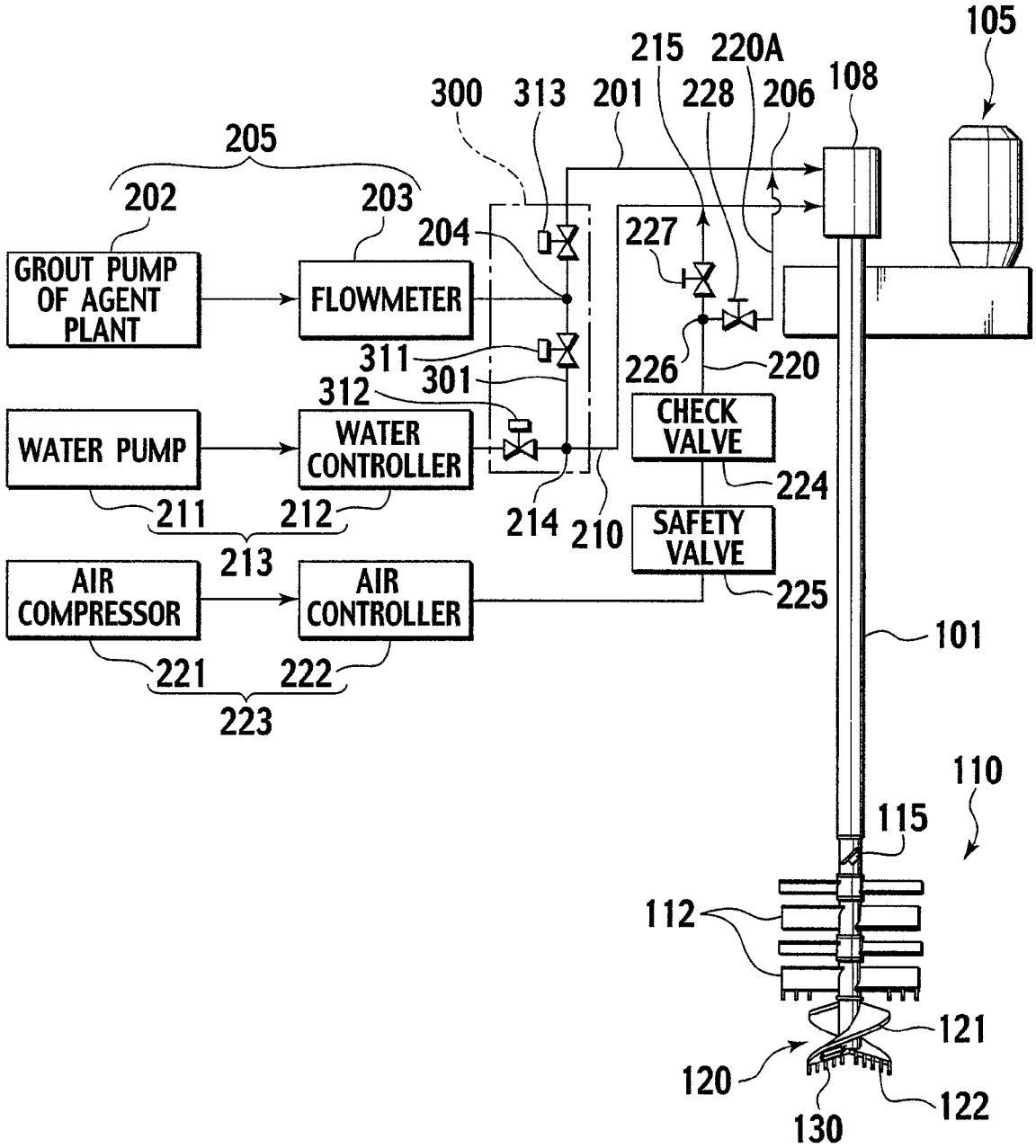
FIG. 12 is a view showing an apparatus for soil improvement work according to still another embodiment of the present invention.

FIG. 12 shows an apparatus for soil improvement work according to a first modification of the present invention.

According to the apparatus of the first modification, stabilizer piping 201 has an air inlet 206. The air inlet 206 is connected to a front end of air piping 220A that is branched from a branch point 226. The branch point 226 is formed in air piping 220 downstream from a check valve 224. This arrangement can introduce compressed air into a stabilizer passed through the stabilizer piping 201. Two valves 227 and 228 are provided for the air piping 220 downstream from the branch point 226, to guide compressed air of the air piping 220 into one of the air inlet 206 of the stabilizer piping 201 and a joint 215 of water piping 210.

When drilling the ground, the valve 227 is opened and the valve 228 is closed to mix compressed air with pressurized water to form a fluid mixture, which is fed to a drilling head 120, thereby achieving the effect of the above-mentioned embodiment. In a mixing operation, the valve 227 is closed and the valve 228 is opened, to mix compressed air with the stabilizer passed through the stabilizer piping 201, so that the air-mixed stabilizer is discharged into and mixed with drilled soil. By mixing compressed air with a stabilizer, the fluidity of the stabilizer can be adjusted to improve the mixing ability of the stabilizer.

For this, the air piping 220A is branched from the air piping 220 on the downstream side of the check valve 224. The valves 227 and 228 are used to determine a connection object of compressed air. This configuration can effectively use compressed air both for drilling and mixing without increasing a facility cost.

Second Modification

Figure 13:
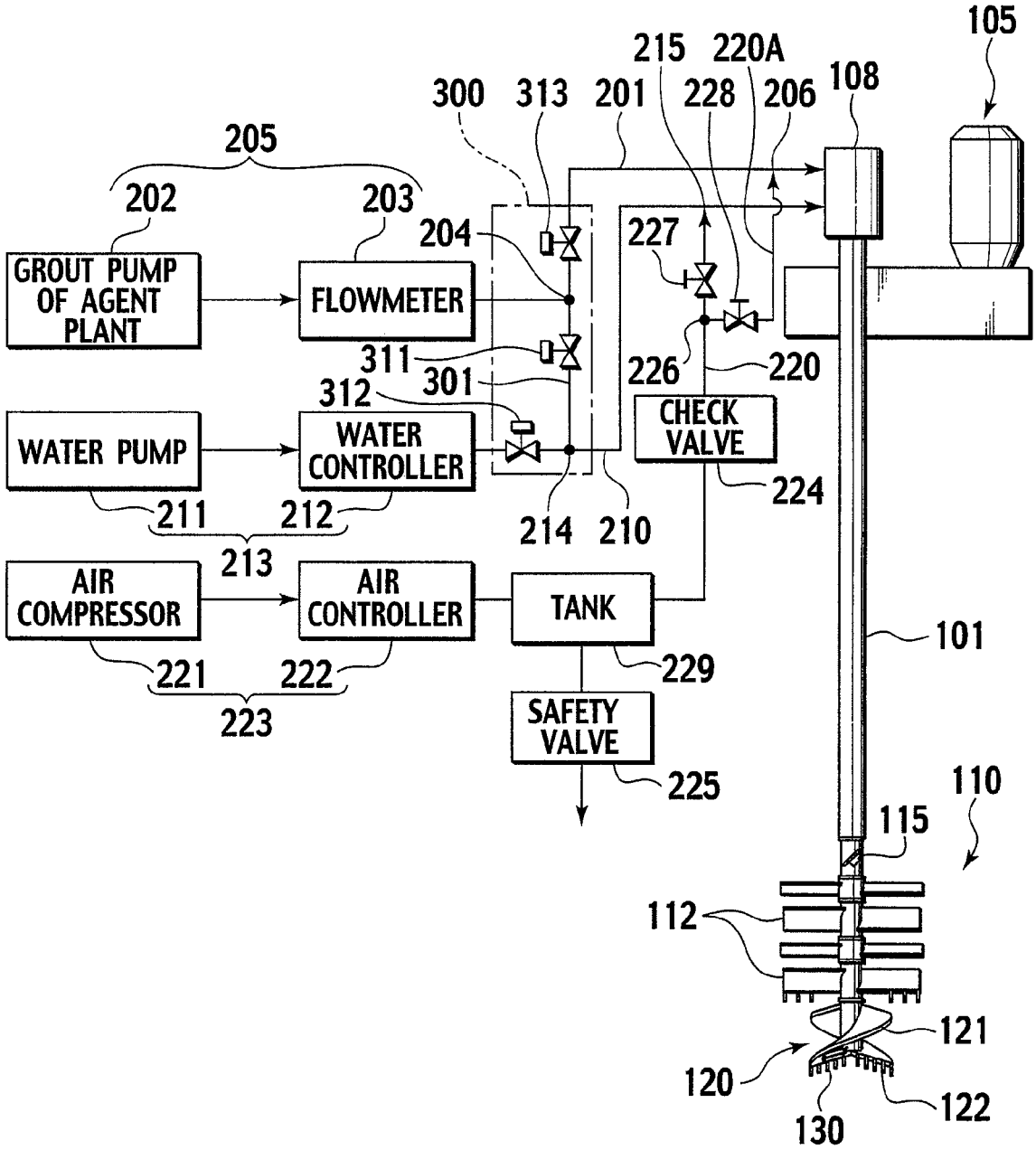
FIG. 13 is a view showing an apparatus for soil improvement work according to still another embodiment of the present invention.

FIG. 13 shows an apparatus for soil improvement work according to a second modification of the present invention.

The second modification is basically the same as the first modification of FIG. 12 except that a tank 229 is arranged in piping between an air controller 222 and a check valve 224 and the tank 229 is connected to a safety valve 225.

Even if water or stabilizer (cement slurry) reversely flows through the check valve 224 toward the air controller 222, the water or stabilizer can be discharged to the outside through the tank 229 and safety valve 225, thereby surely preventing the water or stabilizer from entering the air controller 222.

This application claims benefit of priority under 35 U.S.C. 119 to Japanese Patent Applications No. 2006-244141 filed on Sep. 8, 2006 and No. 2006-244145 filed on Sep. 8, 2006, the entire contents of which are incorporated herein by reference. Although the present invention has been described above by reference to certain embodiments of the present invention, the present invention is not limited to the embodiments described above. Modifications and variations of the embodiments described above will occur to those skilled in the art in light of the teachings. The scope of the present invention is defined with reference to the appended claims.

What is claimed is:

1. A drilling head attached to a lower end of a rotary shaft to be penetrated into the ground, comprising:

a plurality of spiral blades arranged at regular intervals around an axis of rotation of the rotary shaft; and drill bits attached to a lower edge of each of the spiral blades, wherein the lower edges of the spiral blades define an envelope with a central part thereof rising in an upward direction from an outer circumferential part thereof as the rotary shaft is rotated, wherein at least one of the spiral blades is provided with an ejector arranged on a back face of the spiral blade and is configured to eject a resistance reducing fluid that is supplied from a source installed on the ground toward the ground to drill, and wherein the ejector comprises:

a first ejection mouth configured to eject the fluid in a forward direction of a rotational direction of the spiral blades;

a second ejection mouth configured to eject the fluid in a reverse direction of the rotational direction of the spiral blades; and a third ejection mouth configured to eject the fluid in an outward radial direction of the rotational direction of the spiral blades, wherein one of the first, the second, and the third ejection mouths is selectively opened.

2. An apparatus for soil improvement work, comprising:

a rotary shaft vertically supported and to be penetrated into the ground;

a drilling head arranged at a leading end of the rotary shaft;

a lifting driver configured to rotate and move up/down the rotary shaft;

a first conduit arranged along the rotary shaft;

an ejector arranged on the drilling head and connected to a first end of the first conduit;

a water feeder and an air feeder installed on the ground;

water piping configured to feed pressurized water from the water feeder into a second end of the first conduit;

a joint arranged at a location that is upstream from and in the vicinity of a connection between the water piping and the first conduit;

air piping configured to feed compressed air from the air feeder into the joint;

a check valve arranged in the air piping, configured to prevent the pressurized water from reversely flowing from the joint;

a safety valve arranged in the air piping and upstream from the check valve, configured to release pressure if the pressure exceeds a predetermined level;

a mixing blade arranged at a leading end of the rotary shaft above the drilling head;

a second conduit separately arranged from the first conduit along the rotary shaft;

a discharger configured to discharge a stabilizer at a height where the mixing blade is turned, the stabilizer being fed through the second conduit;

a stabilizer feeder installed on the ground, configured to pressurize and feed the stabilizer;

stabilizer piping configured to guide the stabilizer from the stabilizer feeder into an inlet of the second conduit; and a selector having a plurality of valves configured to selectively guide the stabilizer from the stabilizer feeder into one of the first conduit and the second conduit.

3. The apparatus of claim 2, wherein the selector comprises:

connection piping configured to connect the stabilizer piping to the water piping;

a first valve configured to open/close the connection piping;

a second valve configured to be closed to prevent the pressurized water from reversely flowing through the water piping in an upstream direction from a connection between the connection piping and the water piping when the first valve is opened; and a third valve arranged in the stabilizer piping downstream from a connection between the connection piping and the stabilizer piping, to be oppositely opened/closed when the first valve is opened/closed.

4. The apparatus of claim 2, further comprising:

an air inlet formed in the stabilizer piping; and air piping configured to guide the compressed air from the air feeder into the air inlet of the stabilizer piping, so that the compressed air is mixed with the stabilizer fed through the stabilizer piping.

5. The apparatus of claim 4, further comprising:

a branch point formed in the air piping downstream from the check valve, configured to branch the air piping; and a switching valve configured to selectively guide the compressed air from the air piping into one of the joint of the water piping and the air inlet of the stabilizer piping.

* * * * *